United States Patent [19]

Tsubota et al.

[11] 3,930,862

[45] Jan. 6, 1976

[54] DYE DEVELOPER TRANSFER PHOTOSENSITIVE MATERIAL WITH SUBSTITUTED CATECHOL AUXILIARY DEVELOPER

[75] Inventors: Motohiko Tsubota; Yoshiharu Fuseya, both of Minami-ashigara, Japan

[73] Assignee: Fuji Photo Film Co., Ltd., Minami-ashigara, Japan

[22] Filed: May 16, 1974

[21] Appl. No.: 470,507

[30] Foreign Application Priority Data

May 16, 1973 Japan ..... 48-54457

[52] U.S. Cl. ..... 96/73; 96/3; 96/29 D; 96/77; 96/95

[51] Int. Cl.[2] .. G03C 7/00; G03C 5/54; G03C 1/76; G03C 1/40

[58] Field of Search ..... 96/3, 29 D, 77, 66 R, 73, 96/95

[56] References Cited

UNITED STATES PATENTS

| | | | |
|---|---|---|---|
| 2,983,606 | 5/1961 | Rogers | 96/3 |
| 3,002,997 | 10/1961 | Green et al. | 96/66 R |
| 3,146,102 | 8/1964 | Weyerts et al. | 96/3 |
| 3,262,781 | 7/1966 | Ryan et al. | 96/29 D |
| 3,462,266 | 8/1969 | Stewart | 96/77 |
| 3,617,277 | 11/1971 | Stewart | 96/77 |
| 3,653,896 | 4/1972 | Stewart et al. | 96/3 |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A light-sensitive member for use in a color diffusion transfer element which comprises a support having thereon at least one silver halide emulsion layer and at least one dye developing agent combined with the silver halide in the silver halide emulsion layer, wherein at least one layer on the support contains an auxiliary developing agent selected from the group consisting of a catechol having at least one substituent, with at least one of the substituents being selected from the group consisting of an alkoxy group, an acylamino group, an acylimino group, an alkylsulfonamido group, an alkylthio group, an arylthio group, an alkylseleno group, an arylseleno group and a heterocyclic group; dissolved in a substantially water-insoluble solvent and present in the layer as finely divided liquid droplets.

6 Claims, No Drawings

DYE DEVELOPER TRANSFER PHOTOSENSITIVE MATERIAL WITH SUBSTITUTED CATECHOL AUXILIARY DEVELOPER

BACKGROUND OF THE INVENTION

1. Field of the Invention

The present invention relates to color diffusion transfer photographic materials and, in greater detail, to photographic materials which are used in color diffusion transfer processes using dye developing agents.

2. Description of the Prior Art

Diffusion transfer photographic processes using dye developing agents, mainly compounds which are both a developer and a dye have been described in many patents inclusing U.S. Pat. No. 2,983,606 and British Pat. No. 804,971, etc. As is described in these patent specifications, an exposed photosensitive silver halide emulsion is developed in the presence of a dye developing agent and consequently an image-wise distribution of an unreacted unoxidized dye developing agent is formed as a function of exposure and development. The unreacted unoxidized dye developing agent is diffusible in processing solutions and thus at least a part of this image-wise distribution is transferred to a superposed image receiving element.

In a particularly preferred embodiment of these diffusion transfer processes, a photosensitive element containing a silver halide emulsion together with a dye developing agent is exposed to light and a liquid processing composition is supplied to the exposed element by, for example, dipping, applying or spraying. Before, during or after the application of the above described liquid treating composition, the exposed element is superposed on an image receiving element which can mordant the dye developing agent. In a preferred example, a photosensitive element in which a dye developing agent is included in a layer adjacent a silver halide emulsion layer so as to combine with the silver halide in the silver halide emulsion layer is superposed on an image receiving element so as to contact the emulsion layer of the photosensitive element with an image receiving layer of the image receiving element, and a liquid processing composition is supplied as a comparatively thin layer between the photosensitive element and the image receiving element. The liquid processing composition permeates into the emulsion layer and the dye developing agent layer to cause development of the developable silver halide and thus the dye developing agent is immobilized.

This immobilization depends partially upon the fact that diffusibility or solubility of the oxidation products of the dye developing agent is lower than that of the unoxidized dye developing agent. It is further believed that the immobilization depends partially upon localized decrease in alkali concentration as a function of development.

Since the unreacted dye developing agent in the nondeveloped area of the emulsion is diffusible, the image-wise distribution of the diffusible unoxidized dye developing agent is formed as a function of exposure and development of the silver halide emulsion. At least a part of the image-wise distribution of the diffusible unoxidized dye developing agent is transferred to the superposed image receiving layer to form a transfer image on the image receiving layer. When an element comprising a silver halide emulsion layer having a different photosensitivity is combined with a dye developing agent having a different color which is a substantially complementary color to the main sensitive range of the emulsion, namely, where an emulsion sensitive to red light is combined with a cyan dye developing agent, an emulsion sensitive to green light is combined with a magenta dye developing agent or an emulsion sensitive to blue light is combined with a yellow dye developing agent, each dye developing agent is oxidized in the exposed area of the combined emulsion and immobilized therein when each photosensitive element is treated with the liquid processing composition. Thus the residual dye developing agent in the nonexposed area is transferred to the image receiving material by diffusion.

Accordingly, where a large amount of the unoxidized dye developing agent is present in the sufficiently exposed negative area corresponding to a highlight part of an object to be photographed, the unoxidized dye developing agent diffuses into the image receiving material similar to the unoxidized dye developing agent present in the non-exposed area corresponding to a dark part of the object to be photographed, whereby a low contrast transfer image having a high maximum density is formed.

On the other hand, the dye developing agents described in U.S. Pat. Nos. 3,225,001; 2,992,106; 3,297,441; 3,134,762; 3,236,643; 3,134,673; 3,236,645; 3,134,764; 3,134,672; 3,134,765; 3,183,089; 3,135,734; 3,135,604; 3,173,906; 3,222,169; 3,183,090; 3,201,384; 3,246,985; 3,208,991; 3,142,565; 3,218,312; 3,230,086; 3,262,924; 3,275,617; 3,077,402; 3,282,913; 3,141,772; 3,299,041; 3,309,199; 2,983,605; 3,047,386; 3,076,820; 3,173,929; 3,230,083; 3,236,864; 3,239,339; 3,252,969; 3,253,001; 3,288,778; 3,209,016; 3,135,606; 3,076,808; 3,126,280; 3,236,865; 3,135,605; 3,255,205; 3,131,061; 3,347,673; 3,347,672; 3,246,016; 3,245,790; 3,086,005; 3,295,973; 3,307,847; 3,230,082 and 3,230,085, for example, 1,4-bis-(α-methyl-β-hydroquinonylpropylamino)-5,8-dihydroxyanthraquinone as the cyan dye developing agent, 4-propoxy-2-(p-(β-hydroquinonylethyl)phenylazo)-1-naphthol as the magenta dye developing agent and 1-phenyl-3-N-n-hexylcarboxamido-4-(p-2′,5′-dihydroxyphenethyl)phenylazo)-5-pyrazolone as the yellow dye developing agent are weak developing agents for silver halide, even if they are used in a comparatively strongly alkaline range as high as a pH of 13. Accordingly, when these dye developing agents are used, the desired maximum density, gradation and sensitivity can not be obtained. Since the immobilization of the dye developing agents is a function of the development of the emulsion, the resulting transfer image obtained by this process has an undesirable high minimum density at the highlight area, an undesirable low maximum density and a low contrast. It is believed that these are partially due to the weak development activity for silver halide of the dye developing agents and the lack of efficient use of all of the dye developing agent around the silver halide particles.

Further, in a multi-color system, emulsion layers are each developed not only by a dye developing agent having a color which is a substantially complementary color to the main photosensitive range of the layers but also by other dye developing agents in other emulsion layers. For example, a part of a magenta dye developing agent in a green sensitive emulsion diffuses into a blue sensitive emulsion and a red sensitive emulsion to cause the development thereof and is immobilized therein. Consequently, the resulting transfer image is one containing a low amount of the magenta dye.

As described above, if the immobilization of the dye developing agents caused by the development of silver halide emulsions in the exposed area is insufficient, the highlight part exhibits an undesirably high minimum density reducing the image contrast. Further, the dye developing agents transferred by diffusion are immobilized by interference with other emulsion layers to cause a remarkable deterioration of the quality of the finally resulting color positive image.

Japanese Patent Publications Nos. 4839/60, 17383/60, 10240/59, and 2241/62 disclose that some improvements can be attained by accelerating the development of the silver halide using a colorless auxiliary developing agent such as 1-phenyl-3-pyrazolidone in the processing composition to accelerate the immobilization of the dye developing agents in the photosensitive element. For example, Japanese Patent Publication No. 17383/60 suggests a combination of 1-phenyl-3-pyrazolidone with other compounds having development activity and discloses that a part thereof can be added to the photosensitive element. However, the resulting images are not sufficiently satisfactory. Particularly, where these auxiliary developing agents are used for a multi-color type multi-layer photosensitive element, it is difficult to obtain satisfactory multi-color transfer images because the development does not proceed so as to immobilize the dye developing agents to the degree desired for each dye developing agent and to the degree desired for each layer.

Further, sometimes a part of the auxiliary developing agent is transferred to the image receiving element to stain the color image.

Furthermore, the emulsion becomes unstable and aggregation occurs after or during the application thereof, because the above described auxiliary developing agents are easily crystallized at normal temperatures in a supersaturated state when they are dispersed as oil drops.

SUMMARY OF THE INVENTION

One object of the present invention is to fix each dye developing agent in a desired degree and a ratio desired for each layer by using a specific auxiliary developing agent in a multi-color type multi-layer photosensitive element.

Another object of the present invention is to stabilize an emulsion of the auxiliary developing agent at normal temperature in a supersaturated state.

A further object of the present invention is to decrease occurrence of aggregation caused during or after application when the multi-layer photosensitive element is produced using the auxiliary developing agent.

As the result of much research on a color diffusion transfer process the present invention which does not have the above described defects has been accomplished. Namely, the present invention provides a color diffusion transfer photosensitive material which comprises a support having thereon at least one silver halide emulsion layer and dye developing agents combined with the silver halide in the silver halide emulsion layer(s), wherein at least one layer on the support contains an auxiliary developing agent, the auxiliary developing agent being dissolved in a substantially water-insoluble solvent and included as finely divided liquid droplets and being selected from those catechols having at least one substituent, with at least one of the substituents being an alkoxy group, an acylamino group, an acylimino group, an alkylsulfoamide group, an alkylthio group, an arylthio group, an alkylseleno group, an arylseleno group or a heterocyclic group.

DETAILED DESCRIPTION OF THE INVENTION

The auxiliary developing agents of the present invention can be applied to the so-called non-stripable type film unit in which is not necessary to separate the image receiving element from the photosensitive element after image transfer, wherein the image receiving layer is placed between a transparent support and a light-reflective layer and thus the color images formed can be observed through the transparent support. Examples of such film units are described in U.S. Pat. Nos. 2,983,606; 3,415,644; 3,415,645; 3,415,646; 3,594,164 and 3,594,165.

In one non-stripable type film unit, a silver halide emulsion combined with a dye-image forming agent is applied to a light impermeable support and is exposed image-wise to light at the side opposite to the support. After exposure, a processing composition is spread between a surface of the silver halide emulsion layer and an image receiving layer on the transparent support. A light reflective material is included in the processing composition and thus the dye image formed by diffusion in the image receiving layer through the processing solution layer can be observed through the transparent support. In this film unit, it is necessary to use a camera having a specific optical system employing reflection by mirrors, etc., in order to obtain a correct image which is not a mirror image.

In an another non-stripable type film unit, a silver halide emulsion combined with a dye-image forming agent is applied to a transparent support and is exposed image-wise to light through the support. After exposure, a processing composition is spread between a surface of the silver halide emulsion layer and an image receiving layer on the transparent support. The dye image fixed on the image receiving layer formed by diffusion through the treating solution can be observed through the transparent support on the background comprising a light reflective material disposed previously in a layer between the silver halide emulsion layer and the image receiving layer or a light reflective material included in the processing composition is spread in a layer.

In a further non-stripable type film unit, a material wherein an image receiving layer, a light reflective layer, a light shading layer containing a light absorbing material and a silver halide emulsion layer combined with a dye-image forming agent are applied in turn to a transparent support is exposed image-wise to light at the reverse side to the support. Then a processing composition is spread on the surface of the silver halide emulsion. Thus, a dye image formed by diffusion through the light shading layer and the light reflective layer and fixed in the image receiving layer can be observed through the transparent support. Particularly, a unit wherein the surface of the silver halide emulsion layer is covered with a covering sheet and the processing composition containing a light absorbing material is spread between the exposed covering sheet and the surface layer of the emulsion layer can be suitably used. Thus, the present invention can be applied to these three types of non-stripable film units.

In the photosensitive elements used in the present invention, the dye image forming agent is combined with the silver halide emulsion. To obtain the desired color reproduction, a combination of the sensitivity of the silver halide emulsion and the spectral absorption of the dye image is suitably chosen. For obtaining natural color reproduction by subtractive color photography, a photosensitive element containing at least two of a combination of an emulsion having a selective spectral sensitivity in a certain wavelength range and a dye image forming compound having a selective spectral absorption in the same wavelength range is used. A photosensitive element containing a combination of a blue-sensitive silver halide emulsion layer and a yellow image forming compound, a combination of a green-sensitive emulsion and a magenta dye image forming compound and a combination of a red-sensitive emulsion and a cyan dye image forming compound is particularly useful. These combinations of emulsions and dye image forming agents are applied as layers so as to be superposed in the photosensitive element or applied as a mixture of particles thereof. In a preferred multi-layer structure, a blue-sensitive emulsion, a green-sensitive emulsion and a red-sensitive emulsion are disposed in turn at the exposing side. In the case of a high speed emulsion containing iodide, a yellow filter layer can be disposed between the blue-sensitive emulsion and the green-sensitive emulsion. The yellow filter contains a yellow colloidal silver dispersion, an oil-soluble yellow dye dispersion, an acid dye mordanted by a basic polymer or a basic dye mordanted by an acid polymer, etc. It is preferred that the emulsion layers be separated from each other by means of intermediate layers. The intermediate layer inhibits undesirably interaction between each emulsion layer having different sensitivity. The intermediate layer comprises a hydrophilic polymer such as gelatin, polyacrylamide or partially hydrolyzed polyvinylacetate, a polymer having small pores produced from a latex of a hydrophilic polymer and a hydrophobic polymer as described in U.S. Pat. No. 3,625,685, or a polymer wherein the hydrophilic property thereof gradually increased during treatment by the processing composition, such as calcium alginate, described in U.S. Pat. No. 3,384,483. The intermediate layers can contain an interlayer interaction inhibitor which is chosen depending on the types of dye image forming agent used and the processing composition used. For example, in using a dye image forming agent which releases a dye upon reaction with the oxidation product of the developing agent, reducing agents such as non-diffusible hydroquinone derivatives and nondiffusible couplers which can be fixed by reacting with the oxidation product are effectively used in order to prevent undesirable exchange of the oxidation products of the developing agents between the emulsion layers.

The silver halide emulsions used in the present invention are each a colloidal dispersion of silver chloride, silver bromide, silver bromochloride, silver iodobromide, silver iodobromochloride or a mixture thereof. The halide composition can be chosen depending on the end-use objects of the photosensitive materials and processing conditions employed. However, silver iodobromide and silver iodobromochloride emulsions which have 1 to 10% by mol iodide, less than 30% by mole chloride and the balance bromide are particularly preferred. Further, emulsions having an average particle size of about 0.1 to 2 microns are also preferred. Emulsions having a uniform particle size are sometimes preferred. The particles can have a cubic system, an octahedral crystal form or a mixed crystal form.

These silver halide emulsions can be produced by, for example, using known conventional methods described in P. Glafkides, Chimie Photographique, 2 Ed. Chapter 18 – 23, Paul Montel, Paris (1957). Namely, a soluble silver salt such as silver nitrate and a water soluble halide such as potassium bromide are reacted in a protective colloid solution such as a gelatin solution and crystals grown in the presence of excess halide or a silver halide solvent such as ammonia. In this case, a single or double jet method or a pAg control-double jet method can be used for precipitation. Removal of the soluble salts from the emulsion can be carried out by rinsing the emulsion solidified by cooling, by dialysis, by precipitation by adding a precipitant such as an anionic polymer having sulfo groups, sulfate ester groups or carboxyl groups or an anion surface active agent and control of the pH, or by precipitation by using an acylated protein such as phthaloyl gelatin as a protective colloid and control of the pH.

It is desirable that the silver halide emulsions used in the present invention be chemically sensitized by heating using the natural sensitizers contained in gelatin, or using sulfur sensitizers such as sodium thiosulfate or N,N,N'-triethylthiourea, gold sensitizers such as a monovalent gold-thiocyanate complex salt or thiosulfate complex salt, or reduction sensitizers such as stannous chloride or hexamethylenetetramine. In the present invention, the emulsions which can easily form latent images on the surface of particles and the emulsions which can easily form the latent images in the interior of the particles as described in U.S. Pat. Nos. 2,592,550 and 3,206,313 can be used.

The silver halide emulsions used in the present invention can be stabilized using additives such as 4-hydroxy-6-methyl-1,3,3a,7-tetrazaindene, 5-nitroimidazole, 1-phenyl-5-mercaptotetrazole, 8-chloromercury quinoline, benzene sulfinic acid, pyrocatechin, 4-methyl-3-sulfoethylthiazolidine-2-thione and 4-phenyl-3-sulfoethylthiazolidine-2-thione. Furthermore, inorganic compounds such as cadmium salts, mercury salts and complex salts of the platinum group elements such as a palladium chloro complex salt, etc., are useful for stabilization of the photosensitive materials of the present invention. In addition, the silver halide emulsions used in the present invention can contain sensitizing compounds such as polyethyleneoxide compounds.

The silver halide emulsions used in the present invention can have, if desired, a color sensitivity expanded by optical sensitizing dyes. Preferred optical sensitizers which can be used include the cyanines, merocyanines, holopolar cyanines, styryl derivatives, hemicyanines, oxanoles and hemioxanoles, etc. Examples of optical sensitizers are described in P. Glafkides, ibid., Chapter 35 – 41 and F. M. Hammer *The Cyanine Dyes and Related Compounds* (Interscience). Particularly, cyanines wherein the nitrogen atoms thereof are substituted by an aliphatic group containing a hydroxyl group, carboxyl group or sulfo group substituent, for example, those described in U.S. Pat. Nos. 2,503,776; 3,459,553 and 3,177,210 can be suitably used in the present invention.

The silver halide emulsion layers, the layers containing the dye image forming agent and the processing solution permeable layers such as a protective layer and intermediate layers contain hydrophilic polymers as a binder. Preferred hydrophilic polymers include gelatin, casein, modified gelatin treated with acylating agents, grafted gelatin treated with vinyl polymers, proteins such as albumin, cellulose derivatives such as hydroxyethyl cellulose, methyl cellulose and carboxymethyl cellulose, polyvinyl alcohol, partially hydrolyzed polyvinyl acetate, polyvinyl pyrrolidone, high molecular weight nonelectrolytes such as polyacrylamide, polyacrylic acid, partially hydrolyzed polyacrylamide, anionic synthetic polymers such as a vinylmethyl ether-maleic acid copolymer, N-vinyl imidazole, acrylic acid-acrylamide copolymers and ampholytic synthetic polymers such as polyacrylamide treated in a Hofmann reaction. These hydrophilic polymers can be used alone or as a mixture of two or more polymers.

The layers of these hydrophilic polymers can also contain a latex polymer dispersion of hydrophobic monomers such as alkyl acrylates and alkyl methacrylates.

These above described hydrophilic polymers and, particularly polymers having functional groups such as amino groups, hydroxyl groups and carboxyl groups, can be converted into water-insoluble polymers using many kinds of cross-linking agents without losing their processing solution permeability. Preferred cross-linking agents include aldehyde derivatives such as formaldehyde, glyoxal, glutaraldehyde, mucochloric acid or oligomers of acrolein; aziridine compounds such as triethylene phosphamide as described in Japanese Patent Publication No. 8790/62; epoxy compounds such as 1,4-bis-(2′,3′-epoxypropoxy)-diethyl ether as described in Japanese Patent Publication No. 7133/59; active halogen compounds such as sodium salt of 2-hydroxy-4,6-dichloro-s-triazine as described in U.S. Pat. No. 3,325,287; methylol compounds such as N-polymethylol urea or hexamethylol melamine; active olefin compounds such as hexahydro-1,3,5-triacryl-s-triazine; and high molecular weight materials such as dialdehyde starch or 3-hydroxy-5-chloro-s-triazinylated gelatin as described in U.S. Pat. No. 3,362,827. These hydrophilic polymer layers can contain a crosslinking accelerator such as a carbonate or resorcinol in addition to the cross-linking agent.

On the other hand, the auxiliary developing agents which are used in the present invention are catechol derivatives having at least one substituent. At least one of the substituents is an alkoxy group (preferred examples include those having 1 to 8 carbon atoms such as a methoxy group, ethoxy group, propoxy group, isopropoxy group, butoxy group, isobutoxy group, t-butoxy group, pentyloxy group, hexyloxy group or octyloxy group), an acylamino group (preferred examples of the acyl groups thereof include alkanoyl groups having 2 to 5 carbon atoms such as an acetyl group, propanoyl group or butanoyl group, benzoyl group, and substituted benzoyl groups containing an alkyl group having 1 to 4 carbon atoms such as a methyl group, ethyl group, propyl group or butyl group and/or a halogen atom (fluorine, chlorine, bromine or iodine)), an acylimino group (preferred examples of the acyl group thereof include the same acyl groups as set forth above for the acylimino groups, and preferred substituents in addition to the acycl group include alkyl groups having 1 to 4 carbon atoms such as a methyl group, ethyl group, propyl group or butyl group, a phenyl group and substituted phenyl groups containing an alkyl group having 1 to 4 carbon atoms and/or a halogen atom), an alkylsulfoamido group (preferred alkyl groups thereof include a methyl group), an alkylthio group and an alkylseleno group (preferred alkyl groups for the alkylthio and alkylseleno groups include those having 1 to 8 carbon atoms such as a methyl group, ethyl group, propyl group, butyl group, t-butyl group, pentyl group, hexyl group, octyl group or benzyl group), arylthio groups and arylseleno groups (preferred aryl groups of the arylthio and arylseleno groups include a phenyl group) and heterocyclic groups (preferred heterocyclic groups include those having a 5- or 6-member ring containing at least one non-metal atom selected from nitrogen, oxygen, sulfur and selenium, such as a thiazolyl ring, an aminothiazolyl ring or a morpholino ring). Other substituents include halogen atoms (fluorine, chlorine, bromine or iodine), alkyl groups (e.g., those having 1 to 8 carbon atoms such as a methyl group, ethyl group, propyl group, butyl group, pentyl group, hexyl group, heptyl group, octyl group or aminoethyl group), aryl groups (e.g., a phenyl group, tolyl group or naphthyl group), aryloxy groups (e.g., a phenoxy group) and carboxy groups.

The catechol derivatives used in the present invention also include catechol precursors which release the catechol derivatives in alkali solutions, such as compounds wherein one or more hydroxyl groups in the catechol nucleus are acetylated and/or propanoylated.

Examples of catechol derivatives which can be used in the present invention include 4-methoxycatechol, 4-propoxycatechol, 4-octyloxycatechol, 4-t-butoxycatechol, 3,4-dimethoxy-6-methylcatechol, 3,4,5-tribromo-6-methoxycatechol, 3-isobutoxycatechol, 3-hexyloxy-4-methoxycatechol, 5-aminoethyl-3-methoxycatechol, 4-acetylaminocatechol, 4-(N-acetyl-N-methylamino)catechol, 4-acetylamino-5-chlorocatechol, 4-benzoylaminocatechol, 3,5-diacetylaminocatechol, 4-(N-methylsulfoamido)catechol, 4-butylmercaptocatechol, 4-benzylmercaptocatechol, 4-phenylselenocatechol, 4-(2′-morpholino)catechol, 4,4′-(2′-aminothiazolyl)catechol, 3-methyl-4-phenylmercaptocatechol, 3-benzylmercapto-4,6-di-t-butylcatechol, 1,2-diacetoxy-4-methoxybenzene and 2-acetoxy-3,4,5-tribromo-6-methoxyphenol.

The auxiliary developing agent which is used in the present invention is added to at least one layer of the photosensitive material comprising emulsion layers, dye developing agent layers, intermediate layers and a protective laeyr.

The auxiliary developing agent used in the invention is dissolved in a substantially water-insoluble and alkali-permeable organic solvent having a high boiling point, the solution thus obtained is dispersed in an aqueous organic colloid solution such as a gelatin solution, and this dispersion is added to a desired layer described above. Preferred organic solvents having a high boiling point include those described in Japanese Patent Publication No. 29130/64, etc., which have a boiling point of above 170°C. Examples of such solvents include the alkyl esters of phthalic acid wherein the alkyl group thereof has 6 or less carbon atoms such as methyl phthalate, ethyl phthalate, propyl phthalate, n-butyl phthalate, di-n-butyl phthalate, amyl phthalate, isoamyl phthalate and dioctyl phthalate, phosphoric acid esters such as triphenyl phosphate, tricresyl phosphate and diphenyl mono-p-tert-butylphenyl phosphate, and alkylamides or acetanilides such as N-n-butylacetanilide and N-methyl-p-methylacetanilide.

These organic solvents having a high boiling point can be used together with solvents having a boiling point at least 25°C lower such as methyl-, ethyl-, propyl- or butyl-acetate, isopropyl acetate, ethyl propionate, sec-butyl alcohol, carbon tetrachloride, chloroform, benzyl alcohol or 2-, 3- or 4-methyl cyclohexanone, or solvents which are more water-soluble than the above described organic solvents having a high boiling point and which have a solubility of at least 2 parts per 100 parts of water such as methyl isobutyl ketone, β-ethoxyethyl acetate, β-butoxy-β-ethoxyethyl acetate, tetrahydrofurfuryl adipate, diethyleneglycol monoacetate, methoxy triglycol acetate, acetonyl acetone, acetone alcohol, ethyleneglycol, diethyleneglycol, dipropyleneglycol, 2-, 3- or 4-methylcyclohexanone, ethyleneglycol monomethyl ether acetate, diethyleneglycol monobutyl ether, cyclohexanone or triethyl phosphate.

Solvents having a high boiling point in which the auxiliary developing agent was dissolved can contain polymers so as to prevent crystallization of the dissolved auxiliary developing agent. As such polymers, vinyl polymer latexes are preferred. Examples of the polymer latexes include latexes of polyvinyl acetate, polystyrene, polymethyl methacrylate, polymethyl acrylate, polybutyl acrylate, polymethacrylonitrile, polybutadiene, polyisoprene, polyethylene, polyethyl acrylate, polybutyl methacrylate, glycidyl methacrylate-butyl methacrylate copolymers, styrene-butadiene copolymers, styrene-p-methoxystyrene copolymers, styrene-vinyl acetate copolymers, vinyl acetate-vinyl chloride copolymers, vinyl acetate-diethyl maleate copolymers, methyl methacrylate-acrylonitrile copolymers, methyl methacrylate-butadiene copolymers, methyl methacrylate-styrene copolymers, methyl methacrylate-vinyl acetate copolymers, methyl methacrylate-vinylidene chloride copolymers, methyl acrylate-acrylonitrile copolymers, methyl acrylate-butadiene copolymers, methyl acrylate-styrene copolymers, methyl acrylate-vinyl acetate copolymers, methyl acrylate-vinyl chloride copolymers, methyl acrylate-vinylidene chloride copolymers, butyl acrylate-butadiene copolymers, butyl acrylate-styrene copolymers, ethylene-vinyl acetate copolymers, ethylene-vinyl propionate copolymers, ethylene-propylene copolymers, vinyl chloride-acrylonitrile copolymers, styrene-acrylic acid copolymers, styrene-ethyl acrylate copolymers, styrene-acrylamide copolymers, tert-butyl acrylate-ethyl methacrylate copolymers, methyl acrylate-methyl methacrylate copolymers, methyl acrylate-acrylic acid copolymers, ethyl acrylate-acrylic acid copolymers, n-butyl acrylate-acrylic acid copolymers, 2-ethylcyclohexyl acrylate-acrylic acid copolymers, methyl methacrylate-acrylic acid copolymers, ethyl methacrylate-acrylic acid copolymers and methyl methacrylate-ethyl acrylate-methacrylic acid terpolymers.

Furthermore, solvents having a high boiling point in which the auxiliary developing agent is dissolved can contain additives such as antioxidants and hardening agents. Further, they can contain dye developing agents.

Application of the auxiliary developing agent used in the invention can be by dissolving the auxiliary developing agent in an alkali solution containing an organic colloid medium, neutralizing the mixture to form finely divided precipitates, and applying. However, this method has the disadvantage of coloring the solution because the auxiliary developing agent used in the present invention is easily oxidized in an alkali solution. Such a disadvantage does not appear in the method which comprises using the auxiliary developing agent as finely divided oil drops by dissolving the agent in the above described solvents having a high boiling point, and thus the transfer density can be remarkably improved. Further, although the auxiliary developing agent used in the invention can be included in the alkali processing solution for the photosensitive material, this is not preferred, because the auxiliary developing agent is easily oxidized and colored under high alkalinity.

The amount of the auxiliary developing agent used in the invention depends upon the quantity and kind of dye developing agents used, the quantity and kind of silver halide, the layer structure and other factors. However, the auxiliary developing agent can be used in an amount of $5 \times 10^{-1}$ to $5 \times 10^{-5}$ mols/m$^2$ and preferably $5 \times 10^{-2}$ to $5 \times 10^{-4}$ mols/m$^2$. However, the amount is not limited to the above described range.

The auxiliary developing agents used in the present invention can be synthesized using well-known methods, for example, by the process described in *Beilstein*, Vol. VI, pages 759 – 796.

In general, the dye developing agents are dissolved in a solvent or a solvent mixture with heating. The solution is then added to an aqueous solution of a hydrophilic colloid such as a gelatin solution. After being passed through a colloid mill a suitable number of times, the mixture is directly applied or applied after cooling, solidifying, cutting, rinsing and melting again, or is applied after adding a dissolved dispersion of the dye developing agent to the silver halide emulsion before the application thereof. Examples of such solvents are described in Japanese Patent Publication No. 13937/1968 and U.S. Pat. No. 2,322,027.

Suitable dye developing agents which can be used in the present invention are described in U.S. Pat. Nos. 3,255,001; 3,320,063; 2,992,106; 3,297,441; 3,134,762; 3,236,643; 3,134,763; 3,134,764; 3,134,672; 3,134,765; 3,183,089; 3,135,734; 3,135,604; 3,173,906; 3,222,169; 3,183,090; 3,201,384; 3,346,955; 3,208,991; 3,142,565; 2,983,605; 3,047,386; 3,076,820; 3,173,929 and 3,230,083 are all useful.

Examples of the particularly preferred dye developing agents include 4-(p-(2′,5′-dihydroxyphenyl)-phenylazo)-5-acetamido-1-naphthol, 4-(p-(2′,5′-dihydroxyphenethyl)-phenylazo)-5-benzamido-1-naphthol, 1-phenyl-3-methyl-4-(p-(2′,5′-dihydroxyphenethyl)-phenylazo)-5-pyrazolone, 2-(p-(2′,5′-dihydroxyphenethyl)-phenylazo)-4-acetamido-1-naphthol, 2-(p-2′,5′-dihydroxyphenethyl)-phenylazo)-4-amino-1-naphthol, 2-(p-(2′,5′-dihydroxyphenethyl)-phenylazo)-4-methoxy-1-naphthol, 2-(p-(2′,5′-dihydroxyphenethyl)-phenylazo)-4-ethoxy-1-naphthol, 1-phenyl-3-N-n-butyl-carboxamido-4-(p-(2′,5′-dihydroxyphenethyl)-phenylazo)-5-pyrazolone, 1-phenyl-3-N-n-hexylcarboxamido-4-(p-(2′,5′-dihydroxyphenethyl)-phenylazo)-5-pyrazolone, 1-phenyl-3-N-cyclohexylcarboxamido-4-(p-(2′,5′-dihydroxyphenethyl)-phenylazo)-5-pyrazolone, 1-phenyl-3-amino-4-(4′-(p-(2″,5″-dihydroxyphenethyl)-phenylazo)-2′,5′-diethoxyphenylazo)-5-pyrazolone, 1-acetoxy-2-(p-(β-hydroquinonyl)-phenylazo)-4-methoxynaphthalene, 4-isopropoxy-2-(p-(β-hydroquinonylethyl)-phenylazo)-1-naphthol, 1-acetoxy-2-(p-(β-hydroquinonylethyl)-phenylazo)-4-propoxynaphthalene, 1,4-bis-(2′,5′-dihydroxyanilino)-anthraquinone, 1,5-bis-(2′,5′-dihydroxyanilino)-4,8-dihydroxyanthraquinone, 1,4-bis-(β-(2′,5′-dihydroxyphenyl)-isopropylamino)-anthraquinone, 1,4-bis-(β-(2′,5′-dihydroxyphenyl)-ethylamino)-anthraquinone, 1-chloro-4-(β-(2′,5′-dihydroxyphenyl)-ethylamino)-anthraquinone, N-monobenzoyl-1,4-bis-(β-(2′,5′-dihydroxyphenyl)-ethylamino)-anthraquinone and 5,8-dihydroxy-1,4-bis-((β-hydroquinonyl-α-methyl)-ethylamino)-anthraquinone.

If one amino nitrogen atom of the 1,4-bis-(β-(2,5′-dihydroxyphenyl)-ethylamino)-anthraquinone as the cyan dye developing agent is acylated, the color thereof changes to a magenta color, and if both amino nitrogen atoms thereof are acylated, the color changes to an orange yellow color. Similarly, the color of the above described dye developing agents can be changed by acylating hydroxyl groups thereof. Thus, it is possible to change the structure and the color of the dye developing agent during development such as by hydrolysis and consequently it is possible to form a color to be transferred which is different from that of the dye developing agent which exists in the photosensitive element initially. Examples of such compounds are described in U.S. Pat. Nos. 3,579,947; 3,307,947 and 3,336,287.

Similarly, it is also possible to use leuco compounds such as 1-phenyl-3-methyl-4-(2′-methyl-4′-diethylamino)-anilino-5-pyrazolone which do not adversely influence the lower emulsion layers by light shielding, wherein the leuco compounds can be diffused image-wise into the image receiving material from the developed or immobilized non-developing portions and are oxidized to form a dye image therein.

The dye developing agents are generally present in the photosensitive element in combination with the silver halide of the emulsion layers. More specifically, the dye developing agents are allowed to be present in one or more emulsion layers and preferably in hydrophilic organic colloid layer which is adjacent the silver halide emulsion layer and is on the reverse side to incident light on exposure. Particularly, in the multi-color multi-layer photosensitive elements, it is more preferred that the dye developing agent be present in a layer which is adjacent an emulsion layer and is on the reverse side to incident light at exposure, in which the main sensitive range of the emulsion layer has a complementary color to the dye developing agent. However, where the dye developing agent which does not previously have a complementary color but produces a desired color on the image receiving layer by development is used, the dye developing agent can be included in the same layer as the combined emulsion layer or in an upper layer adjacent the emulsion layer. Further, with respect to the combination of the dye developing agent with silver halide, it is possible to have the condition in which the dye developing agent is included in the colloid which surrounds the silver halide particles or granules.

The photographic layers used in the present invention can be applied using many kinds of application techniques such as a dip coating method, a roll coating method, an air knife method, a bead coating method as described in U.S. Pat. No. 2,681,294 and a curtain coating method as described in U.S. Pat. No. 3,508,947 or 3,513,017. Particularly in a multi-layer photosensitive element, it is convenient to apply a number of layers at the same time using a multi-slit hopper as described in U.S. Pat. Nos. 2,761,417; 2,761,418; 2,761,419 or 2,761,791.

In order to facilitate the application of the photographic layers used in the present invention, it is advantageous that the coating compositions contain many kinds of surface active materials as coating assistants. Preferred coating assistants include saponin, nonionic surface active agents such as ethylene oxide addition products of ethoxyethylene with p-nonylphenol, alkyl ethers of sucrose and monoalkyl ethers of glycerin, anionic surface active agents such as sodium dodecyl sulfate, sodium p-dodecylbenzene sulfonate and sodium dioctyl sulfosuccinate, and ampholytic surface active agents such as carboxymethyl lauryl ammonium hydroxide inner salt, "Deriphat 151", trade name produced by General Mills, Inc., and the betaine compounds as described in U.S. Pat. No. 3,441,413, British Pat. No. 1,159,825 and Japanese Patent Publication No. 21985/71.

In order to facilitate the application of the photographic layers used in the present invention, the coating compositions can contain many kinds of viscosity increasing agents. For example, anionic polymers which provide an increase in viscosity by interaction with binder polymers in the coating compositions such as cellulose sulfate esters, poly-p-sulfostyrene potassium salt and acrylic acid type polymers as described in U.S. Pat. No. 3,655,407 are useful as well as materials which increase the viscosity of the coating compositions due to their high viscosity such as high molecular weight polyacrylamide.

The image receiving elements used in the present invention fix the dye image forming materials such as a diffusible dye which is released image-wise from the dye image forming agent combined with the silver halide emulsion. Where the dye image forming material is an anionic material such as a dye developing agent having a hydroquinonyl group or a color forming dye having a water solubilizing acid group, it is preferred that the image receiving element contains a basic polymer or a basic surface active agent. Suitable basic polymers are those having a tertiary or quaternary nitrogen atom. Examples of such basic polymers include poly-4-vinylpyridine; aminoguanidine derivatives of vinylmethylketone as described in U.S. Pat. No. 2,882,156; poly-4-vinyl-N-benzyl-pyridinium p-toluenesulfonate, poly-3-vinyl-4-methyl-N-n-butylpyridinium bromide; styrene-N-(3-maleimidopropyl)-N,N-dimethyl-N-(4-phenylbenzyl)ammonium chloride copolymer as described in British Patent No. 1,261,925; and poly-(N-(2-methacryloylethyl)-N,N-dimethyl-N-benzyl ammonium chloride), etc. As the basic surface active agents, those having an onium residue such as an ammonium sulfonium or phosphonium group together with a hydrophobic residue such as a higher alkyl group can be suitably used. Examples of such basic surface active agents include N-laurylpyridinium bromide, methyl-tri-n-lauryl ammonium p-toluene-sulfonate, methyl-ethyl-cetyl sulfonium iodide and benzine-triphenyl phosphonium chloride. In addition to these basic compounds compounds of polyvalent metals such as thorium, aluminium or zirconium also have a fixing function to the anionic dye forming materials. It is advantageous to use these materials together with polymers such as gelatin (particularly, acid treated gelatin), polyvinyl alcohol, polyacrylamide, polyvinyl methyl ether, hydroxyethyl cellulose, N-methoxymethyl-polyhexylmethylene adipate and polyvinyl pyrrolidone so as to form a film.

When the dye image forming material is a component for color formation such as a diffusible coupler, the image receiving layer contains another coupling component which forms a dye by reacting with the component, for example, a p-phenylenediamine derivative, and an oxidizing agent or a diazonium compound. As such an image receiving element, those described in U.S. Pat. Nos. 2,647,049; 2,661,293; 2,802,735; 2,698,244; 2,698,798; 3,676,124 and British Patent 1,158,440 and 1,157,507 can be suitably used.

It is preferred that the image receiving elements used in the present invention have a function of neutralizing alkali brought from the processing compositions. In order to provide a pH as high as 10 or higher and preferably above 11 so as to accelerate the image formation comprising development of the silver halide emulsions and formation and diffusion of the diffusible dye image forming agent, the processing compositions contain alkalis. After the formation of the diffusion transfer image is substantially concluded, the pH in the film unit is reduced to a neutral range, more specifically, less than 9 and preferably less than 8 so as to substantially stop the image formation step, whereby deterioration of image tone with the lapse of time is prevented and discoloration of the image and staining caused by high alkalinity are inhibited. For this purpose, it is preferred that the film unit have a neutralizing layer which contains an acid material in an amount sufficient to neutralize the alkali in the treating solution to the above described pH, that is, more than an equimolar amount based on the amount of alkali in the spread treating solution. Preferred acid materials are those having acid groups of a pKa of less than 9, and particularly a carboxyl group or a sulfo group, or precursor groups which form such acid groups by hydrolysis can be used. More preferred materials include higher fatty acids described in U.S. Pat. No. 2,983,606 such as oleic acid, and polymers of acrylic acid, methacrylic acid or maleic acid, the partial esters thereof or the acid anhydride thereof as described in U.S. Pat. No. 3,362,819. Examples of the high molecular weight acid materials include copolymers of a vinyl monomer such as ethylene, vinyl acetate or vinyl methyl ether and maleic acid anhydride, n-butyl semiesters of these copolymers, copolymers of butyl acrylate and acrylic acid, and cellulose acetate acid phthalate. The neutralizing layer can contain polymers such as cellulose nitrate or polyvinyl acetate in addition to the above described acid materials. Further the neutralizing layer can contain plasticizers as described in U.S. Pat. No. 3,557,237. Furthermore, the neutralizing layer can be hardened with a cross-linking reaction by polyfunctional aziridine compounds or epoxy compounds. The neutralizing layer is disposed in the image receiving element and/or the photosensitive element. Particularly, it is more advantageous that the neutralizing layer be placed between the support and the image receiving layer of the image receiving element. As described in German Patent Publication (OSL) No. 2,038,254, the acid materials can be incorporated in the film units as microcapsules.

It is preferred that the neutralizing layer or the acid material containing layer used in the present invention be isolated from the spread treating solution layer by a layer for controlling the rate of neutralization. This layer for controlling the neutralization rate has the function of preventing an undesirable deterioration of the transfer image density resulting from a too rapid decrease of the pH on processing due to the neutralizing layer before the development of the desired silver halide emulsion and the formation of a diffusion transfer image are carried out, and the function of delaying the decrease of the pH after the desired development and transfer are carried out. In a preferred embodiment of the present invention, the image receiving part has a multi-layer structure comprising a support—a neutralizing layer—a layer for controlling the neutralization rate—a mordant layer (image receiving layer). The layer for controlling the neutralization rate comprises polymers such as gelatin, polyvinyl alcohol, polyvinyl propyl ether, polyacrylamide, hydroxypropylmethyl cellulose, isopropyl cellulose, partially butyrated polyvinyl alcohol, partially hydrolyzed polyvinyl acetate, and copolymer of $\beta$-hydroxyethyl methacrylate and ethyl acrylate as main components. Of these polymers, those which can be hardened by a cross-linking reaction by aldehyde compounds such as formaldehyde or N-methylol compounds are useful. It is preferred that the layer for controlling the neutralization rate have a thickness of about 2 to 20 microns.

The processing composition used in the present invention is a liquid composition which contains the processing components necessary to develop the silver halide emulsions and to form the diffusion transfer dye images, wherein the solvent of the composition comprises water as a main component and can contain hydrophilic solvents such as methanol or methyl cellosolve. The processing composition contains alkalis in an amount sufficient to maintain the pH necessary for development of the emulsion layers and to neutralize the acids formed during the development and dye image forming steps. As the alkalis, lithium hydroxide, sodium hydroxide, potassium hydroxide, a calcium hydroxide dispersion, tetramethyl ammonium hydroxide, sodium carbonate, sodium tertiary phosphate and diethylamine can be suitably used. In addition, it is preferred to add sodium hydroxide to the processing composition in an amount sufficient to maintain the pH to above about 12 and preferably above 14 at room temperature. More preferred processing compositions contain hydrophilic polymers such as high molecular weight polyvinyl alcohol, hydroxyethyl cellulose or sodium carboxymethyl cellulose. These polymers not only provide the processing composition with a viscosity at room temperature of about 1 poise and preferably several hundreds to 1000 poises so as to facilitate uniform spreading of the composition in the processing but also form a non-fluid film when the processing composition is concentrated by movement of the aqueous solvent into the photosensitive element and the image receiving element during the processing to help unify the film unit after the processing. This polymer film can serve to prevent discoloration of the color image after conclusion of the formation of the image by diffusion transfer, because the film inhibits further movement of coloring components into the image receiving layer.

It is sometimes advantageous that the processing composition contains a light absorbing material such as carbon black and a desensitizer as described in U.S. Pat. No. 3,579,333 in order to prevent fogging of the silver halide emulsions by external light during the processing. Furthermore, it is preferred that the treating composition contains processing components appropriate to the dye image forming agents employed. For example, where dye developing agents are used, an onium type development accelerator such as N-benzyl-α-picolinium bromide and an antifogging agent such as benzotriazole are used.

Still more, it is possible to add the auxiliary developing agent of the present invention.

In the color diffusion transfer process of the present invention, it is preferred to carry out the development in the presence of a diffusible onium compound. Such onium compounds include quaternary ammonium compounds, quaternary phosphonium compounds and quaternary sulfonium compounds. Examples of the preferred onium compounds include 1-benzyl-2-picolinium bromide, 1-(3-bromopropyl)-2-picolinium p-toluenesulfonic acid, 1-phenethyl-2-picolinium bromide, 2,4-dimethyl-1-phenethylpyridinium bromide, α-picoline-β-naphthoylmethyl bromide, N,N-diethylpyperidinium bromide, phenethyltrimethylphosphonium bromide and dodecyldimethylsulfonium p-toluenesulfonic acid. It is preferred that the onium compounds be included in the alkali processing composition. It is most preferred that the onium compounds be used in an amount of about 2 to 15% by weight based on the total processing composition. By carrying out the development in the presence of the onium compound, the quality of the transferred dye images is remarkably improved. Other onium compounds and the manners of their use are described in U.S. Pat. Nos. 3,411,904 and 3,173,786. It is also possible to add a development inhibitor such as benzotriazole to the processing composition.

In the color diffusion transfer photographic sensitive materials of the present invention, the auxiliary developing agent does not aggregate after application. Accordingly, leaking of the developing agent is efficiently prevented and sharp color images can be obtained.

As typical supports which can be used, cellulose nitrate film, cellulose acetate film, polyvinyl acetate film, polystyrene film, polyethyleneterephthalate film, polyethylene film, polypropyrene film, paper, polyethylene-coated paper, glass can be used. In addition a nega light sensitive element can also be used. The support can be transparent or non-transparent as desired depending on the end-use purposes.

The present invention will be illustrated in greater detail by reference to the following examples. Unless otherwise indicated, all parts, percents, ratios and the like are by weight.

EXAMPLE 1

The following layers were applied in turn to a cellulose triacetate support to produce a film.

FILM A

1. Yellow dye developing agent layer:

10g of the yellow dye developing agent: 1-phenyl-3-N-n-hexylcarboxamido-4-(p-2′,5′-dihydroxyphenethyl-phenylazo)-5-pyrazolone was dissolved in a solvent mixture of 10cc of N-n-butylacetanilide and 25cc of cyclohexanone. The resulting solution was dispersed in 100cc of a 10 wt% aqueous gelatin solution containing 8cc of a 5% aqueous solution of sodium n-dodecylbenzene sulfonate. To the resulting emulsion, 5cc of a 2 wt% aqueous solution of 2-hydroxy-4,6-dichloro-s-triazine sodium salt was added, and water was then added thereto to make 300cc. Then the emulsion solution was applied so as to provide a film of a dry thickness of 6μ.

2. Photosensitive silver halide emulsion layer:

A silver iodobromide emulsion containing $3.5 \times 10^{-2}$ mols of silver and 0.5g of gelatin per 100g of the emulsion (which contained 5% by mol of silver iodide) was applied so as to provide a film of a dry thickness of 1.5μ.

3. Protective layer:

100 cc of a 5 wt% aqueous gelatin solution containing 2cc of a 5 wt% aqueous solution of sodium n-dodecylbenzene sulfonate and 5cc of 2% mucochloric acid was applied as the coating solution so as to provide a film of a dry thickness of 1.5μ. Thus Film A was produced.

FILM B

A similar film to Film A was produced in the same manner as for Film A but a photosensitive silver halide emulsion coating solution was used which further contained 20g of an emulsion which was produced by dissolving 8.4g (0.06 mols) of 4-methoxycatechol as an auxiliary developing agent of the present invention in a solvent mixture of 10cc of tri-o-cresyl phosphate and 20cc of ethyl acetate and dispersing the resulting solution in 500cc of a 10% aqueous gelatin solution using a mixer.

FILM C

A similar film to Film B was produced in the same manner as for Film B but a photosensitive silver halide emulsion coating solution was used which contained 11.0g (0.06 mols) of 3,4-dimethoxy-6-methylcatechol as the auxiliary developing agent of the invention instead of 4-methoxycatechol.

FILM D

A similar film to Film B was produced in the same manner as for Film B but a photosensitive silver halide emulsion coating solution was used which contained 10.9g (0.06 mols) of 4-y-butoxycatechol as the auxiliary developing agent instead of 4-methoxycatechol.

FILM E

A similar film to Film B was produced in the same manner as for Film B but a photosensitive silver halide emulsion coating solution was used which contained 10.9g (0.06 mols) of 3-isobutoxycatechol as the auxiliary developing agent of the invention instead of 4-methoxycatechol.

The prepared Films A to E were exposed to incandescent light. Then the following image receiving elements were placed on the exposed films and transfer development was carried out using the following processing composition. The processing composition was used in an amount of 1.8cc per 100cm² of the image receiving element.

| Processing Composition: | |
|---|---|
| Water | 100 cc |
| KOH | 11.2 g |
| Hydroxyethyl Cellulose (High viscosity Natrosol, produced by Hercules Corp.) | 3.4 g |
| Benzotriazole | 3.5 g |
| N-Benzyl-α-picolinium bromide | 2.0 g |
| Zinc Nitrate | 0.5 g |
| Potassium Thiosulfate | 0.5 g |
| Lithium Nitrate | 0.5 g |

Image Receiving Element:

A solution prepared by adding 2g of poly-4-vinylpyridine (mordant) and 0.1g of 1-phenyl-5-mercaptotetrazole with 100g of a 10% aqueous gelatin solution was applied to a sheet of baryta paper so as to provide a film of a dry thickness of 10$\mu$.

After 1 minute, the image receiving element was separated from the photosensitive element and the blue filter reflection density of the yellow image transferred to the image receiving element was measured. The maximum transfer density and the minimum transfer density results were as follows:

TABLE 1

| Film | Minimum Density | Maximum Density |
|---|---|---|
| A | 0.55 | 1.44 |
| B | 0.37 | 1.48 |
| C | 0.32 | 1.52 |
| D | 0.31 | 1.46 |
| E | 0.30 | 1.50 |

As is shown in the table, it can be understood that the minimum density is lower and the maximum density is higher in Films B to E wherein the auxiliary developing agents of the present invention were used as compared with the film containing no auxiliary developing agent.

Furthermore, in the resulting films, difficulties caused by crystallization of the emulsified materials before or during application did not occur.

EXAMPLE 2

Films F to L were produced as follows.

FILM F

The following layers were applied in turn to a cellulose triacetate support to produce a multi-layer photosensitive element.

1. Cyan dye developing agent layer:

15g of 1,4-bis-($\alpha$-methyl-$\beta$-hydroquinonylpropylamino)-5,8-dihydroxyanthraquinone was dissolved in a solvent mixture of 25cc of N,N-diethylaurylamide, 25cc of methyl cyclohexanone and 1g of sodium dioctyl sulfosuccinate with heating to 70°C. This solution was emulsified in 160cc of a 10 wt% gelatin solution containing 10cc of a 5 wt% aqueous solution of sodium n-dodecylbenzene sulfonate. Then water was added thereto to make the volume 500cc. The resulting emulsion was applied so as to provide a film of a dry thickness of 5$\mu$.

2. Red-sensitive emulsion layer:

A red-sensitive silver iodobromide emulsion containing $5.5 \times 10^{-2}$ mols of silver and 5.0g of gelatin per 100g of the emulsion (which contained 1% by mol of silver iodide) was applied so as to provide a film of a dry thickness of 5$\mu$.

3. Intermediate layer:

100cc of a 5 wt% aqueous gelatin solution containing 1.5cc of a 5 wt% aqueous solution of sodium n-dodecylbenzene sulfonate was applied so as to provdie a film of a dry thickness of 1.5$\mu$.

4. Magenta dye developing agent layer:

10g of a magenta dye developing agent (4-propoxy-2-(p-($\beta$-hydrozuinonylethyl)-phenylazo)-1-naphthol) was dissolved in a solvent mixture of 20cc of butyl acetanilide and 25cc of methylcyclohexanone with heating. The solution was then emulsified in 120cc of a 10 wt% gelatin solution containing 8cc of a 5 wt% aqueous solution of sodium n-dodecylbenzene sulfonate. Then, water was added thereto to make the volume 400cc. The resulting emulsion was applied so as to provide a film of a dry thickness of 3.5$\mu$.

5. Green-sensitive emulsion layer:

A green-sensitive iodobromide emulsion containing $4.7 \times 10^{-2}$ mols of silver and 6.2g of gelatin per 100g of the emulsion (which contained 2% by mol of silver iodobromide) was applied so as to provide a film of a dry thickness of 1.8$\mu$.

6. Intermediate layer:

100cc of a 5 wt% aqueous solution of sodum n-dodecylbenzene sulfonate was applied so as to provide a film of a dry thickness of 1.0$\mu$.

7. Yellow dye developing agent layer:

10g of a yellow dye developing agent (1-phenyl-3-N-n-hexylcarboxamide-4-(p-2′,5′--dihydroxyphenethyl)-phenylazo-5-pyrazolone) was dissolved in a solvent mixture of 10cc of N-n-butyl acetanilide and 25cc of cyclohexanone with heating. This solution was emulsified in 100cc of a 10 wt% gelatin solution containing 8cc of a 5 wt% aqueous solution of sodium n-dodecyl benzene sulfonate. To the resulting emulsion, 5cc of a 2 wt% aqueous solution of 2-hydroxy-4,6-dichloro-s-triazine was added and further water was added to make the volume 300cc. This emulsion was applied so as to provide a film of a dry thickness of 1.5$\mu$.

8. Blue-sensitive emulsion layer:

A blue-sensitive silver iodobromide emulsion containing $3.5 \times 10^{-2}$ mols of silver and 6.5g of gelatin per 100g of the emulsion (which contained 7% by mol of silver iodide) was applied so as to provide a film of a dry thickness of 1.5$\mu$.

9. Protective layer:

A 4 wt% aqueous gelatin solution containing 2cc of a 5 wt% aqueous solution of sodium n-dodecylbenzene sulfonate and 5cc of 2 wt% mucochloric acid was applied as a coating solution so as to provide a film of a dry thickness of 1$\mu$.

FILM G

A similar film to Film F was produced in the same manner as for Film F but the protective layer thereof was produced by dissolving 5g of 1-phenyl-3-pyrazolidone in a solvent mixture of 10cc of tri-o-cresyl phosphate and 20cc of ethyl acetate, emulsifying the resulting solution in 50cc of a 10 wt% aqueous gelatin solution using colloid mill, and applying the resulting emulsion so as to provide a film of a dry thickness of 1$\mu$.

FILM H

A similar film to Film G was produced in the same manner as for Film G but the coating solution for the protective layer contained 8.00g of 4-methoxycatechol as the auxiliary developing agent of the invention instead of 1-phenyl-3-pyrazolidone.

FILM I

A similar film to Film G was produced in the same manner as for Film G but the solution for the protective layer contained 10.00g of 4-t-butoxycatechol as the auxiliary developing agent of the invention instead of 1-phenyl-3-pyrazolidone.

The prepared Films F to I were exposed to incandescent light and transfer development was carried out for 1 minute using the same processing composition and the same image receiving sheet as in Example 1. The processing composition was used in an amount of 1.5cc per 100cm$^2$ of the image receiving sheet. The reflection densities of the transferred dye image were measured using red, green and blue filters. The minimum transfer density and the maximum transfer density results obtained are shown below.

TABLE 2

| Film | Filter | Minimum Density | Maximum Density |
|---|---|---|---|
| F | Blue | 0.48 | 1.07 |
| | Green | 0.40 | 1.40 |
| | Red | 0.45 | 1.05 |
| G | Blue | 0.40 | 1.02 |
| | Green | 0.35 | 1.28 |
| | Red | 0.44 | 1.00 |
| H | Blue | 0.30 | 1.15 |
| | Green | 0.22 | 1.41 |
| | Red | 0.31 | 1.18 |
| I | Blue | 0.30 | 1.11 |
| | Green | 0.23 | 1.44 |
| | Red | 0.33 | 1.08 |

It can be understood from these results that Films H and I wherein the auxiliary developing agents were added are remarkably improved as compared with Film F not containing the auxiliary developing agent. Namely, Films H to I have a lower minimum density and a higher maximum density than those of Film F. Furthermore, they have low color contamination and good color separation as compared with Film G containing 1-phenyl-3-pyrazolidone, and consequently, transfer positive images having excellent color reproducibility and low color mixing are obtained. Moreover, no difficulties caused by aggregation of the emulsified materials before and during application were observed for the resulting films.

EXAMPLE 3

The same treatment was carried out as described in Example 1 using the following Films J to M. For comparison, Film A prepared in Example 1 was also used. The results obtained are shown in Table 3.

FILM J

A similar film to Film A was produced in the same manner as for Film A but the photosensitive silver halide emulsion coating solution in Film A further contained 20g of an emulsion which was prepared by dissolving 10.0g (0.06 mols) of 4-acetylaminocatechol as an auxiliary developing agent of the invention in a solvent mixture of 10cc of tri-o-cresyl-phosphate and 20cc of ethyl acetate and emulsifying the resulting solution in 50cc of a 10% aqueous gelatin solution using a mixer.

FILM K

A similar film to Film J was produced in the same manner as for Film J but the photosensitive silver halide emulsion coating solution contained 10.9g (0.06 mols) of 4-(N-acetyl-N-methylamino)-catechol as an auxiliary developing agent of the invention instead of 4-acetylaminocatechol.

FILM L

A similar film to Film J was produced in the same manner as for Film J but the photosensitive silver halide emulsion coating solution contained 13.8g (0.06 mols) of 4-benzoyl-aminocatechol as an auxiliary developing agent of the invention instead of 4-acetylaminocatechol.

FILM M

A similar film to Film J was produced in the same manner as for Film J but the photosensitive silver halide emulsion coating solution contained 12.2g (0.06 mols) of 4-acetylamino-5-chlorocatechol instead of 4-acetylaminocatechol.

TABLE 3

| Film | Minimum Density | Maximum Density |
|---|---|---|
| A | 0.58 | 1.50 |
| J | 0.37 | 1.55 |
| K | 0.31 | 1.58 |
| L | 0.35 | 1.62 |
| M | 0.30 | 1.51 |

It can be understood that Films J to M containing the auxiliary developing agents have a lower minimum density and a higher maximum density than those of the film not containing the auxiliary developing agent.

No difficulties due to crystallization of emulsified materials during and before application were observed for the resulting films.

EXAMPLE 4

The same treatment as described in Example 2 was carried out using the following Films N and O. For the comparison, Films F and G prepared in Example 2 were also used. The results obtained are shown in Table 4.

FILM N

A similar film to Film G in Example 2 was produced in the same manner as for Film G but the coating solution for the protective layer contained 17.0g of 3,5-diacetylaminocatechol as an auxiliary developing agent instead of 1-phenyl-3-pyrazolidone.

FILM O

A similar film to Film G was produced in the same manner as for Film G but the coating solution for the protective layer contained 11.0g of 4-(N-acetyl-N-methylamino)catechol as an auxiliary developing agent of the invention instead of 1-phenyl-3-pyrazolidone.

TABLE 4

| Film | Filter | Minimum Density | Maximum Density |
|---|---|---|---|
| F | Blue | 0.48 | 1.08 |
| | Green | 0.42 | 1.39 |
| | Red | 0.43 | 1.00 |
| G | Blue | 0.41 | 1.00 |
| | Green | 0.35 | 1.27 |
| | Red | 0.40 | 1.98 |
| N | Blue | 0.35 | 1.10 |
| | Green | 0.29 | 1.40 |
| | Red | 0.30 | 1.10 |
| O | Blue | 0.30 | 1.21 |
| | Green | 0.22 | 1.41 |
| | Red | 0.33 | 1.20 |

The same results as described in Example 2 were obtained.

EXAMPLE 5

The same treatment as described in Example 1 was carried out but the following Films P to S were used. For the comparison, Film A prepared in Example 1 was also used. The results obtained are shown in Table 5.

FILM P

A similar film to Film A of Example 1 was produced in the same manner as for Film A but the photosensitive silver halide emulsion coating solution additionally contained 20g of an emulsion produced by dissolving 11.9g (0.06 mols) of 4-butylmercaptocatechol as an auxiliary developing agent in a solvent mixture of 10cc of tri-o-cresylphosphate and 20cc of ethyl acetate and dispersing the resulting solution in 50cc of a 10% aqueous gelatin solution using a mixer.

FILM Q

A similar film to Film P was produced in the same manner as for Film P but the photosensitive silver halide emulsion coating solution contained 10.9g (0.06 mols) of 4-2'-morpholinocatechol as an auxiliary developing agent of the invention instead of 4-butylmercaptocatechol.

FILM R

A similar film to Film P was produced in the same manner as for Film P but the photosensitive silver halide emulsion coating solution contained 13.9g (0.06 mols) of 3-methyl-4-phenylmercaptocatechol as an auxiliary developing agent of the invention instead of 4-butylmercaptocatechol.

FILM S

A similar film to Film P was produced in the same manner as for Film P but the photosensitive silver halide emulsion coating solution contained 15.9g (0.06 mols) of 4-phenylselenocatechol as an auxiliary developing agent of the invention instead of 4-butylmercaptocatechol.

TABLE 5

| Film | Minimum Density | Maximum Density |
|---|---|---|
| A | 0.58 | 1.42 |
| P | 0.31 | 1.47 |
| Q | 0.35 | 1.50 |
| R | 0.28 | 1.50 |
| S | 0.30 | 1.45 |

As is shown in Table 5, it can be understood that Films P to S wherein the auxiliary developing agents of the present invention are used have a lower minimum density and a higher maximum density than those in the film not containing the auxiliary developing agent.

Further, no difficulties were caused by crystallization of the emulsified materials during or before application in the resulting films.

EXAMPLE 6

The same treatment as described in Example 2 was carried out using the following Films T and U. For the comparison, Films F and G prepared in Example 2 were also used. The results obtained are shown in Table 6.

FILM T

A similar film to Film G was produced in the same manner as for Film G but the coating solution for the protective layer contained 1.70g of 4-phenylselenocatechol as an auxiliary developing agent instead of 1-phenyl-3-pyrazolidone.

FILM U

A similar film to Film G was produced in the same manner as for Film G but the coating solution for the protective layer contained 11.5g of 4-butylmercaptocatechol as the auxiliary developing agent of the invention instead of 1-phenyl-3-pyrazolidone.

TABLE 6

| Film | Filter | Minimum Density | Maximum Density |
|---|---|---|---|
| F | Blue | 0.45 | 1.08 |
| | Green | 0.40 | 1.41 |
| | Red | 0.47 | 1.07 |
| G | Blue | 0.40 | 1.02 |
| | Green | 0.35 | 1.28 |
| | Red | 0.44 | 1.00 |
| T | Blue | 0.33 | 1.15 |
| | Green | 0.28 | 1.44 |
| | Red | 0.31 | 1.08 |
| U | Blue | 0.35 | 1.11 |
| | Green | 0.25 | 1.41 |
| | Red | 0.33 | 1.30 |

The same results as described in Example 2 were obtained.

While the invention has been described in detail and with reference to specific embodiments thereof, it will be apparent to one skilled in the art that various changes and modifications can be made therein without departing from the spirit and scope thereof.

What is claimed is:

1. A light-sensitive member for use in a color diffusion transfer element which comprises a support having thereon at least one silver halide emulsion layer and at least one dye developing agent combined with the silver halide in said silver halide emulsion layer, wherein at least one layer on said support contains an auxiliary developing agent selected from the group consisting of a catechol having at least one substituent selected from the group consisting of an alkoxy group, an acylamino group, an acylimino group, an alkylsulfonamido group, an alkylthio group, an arylthio group, an alkylseleno group, an arylseleno group and a heterocyclic group; dissolved in a substantially water-insoluble solvent and present in said layer as finely divided liquid droplets.

2. The light-sensitive member for use in a color diffusion transfer element of claim 1, wherein said alkoxy group is a methoxy group, an ethoxy group, a propoxy group, an isopropoxy group, a butoxy group, an isobutoxy group, a t-butoxy group, a pentyloxy group, a hexyloxy group or an octyloxy group; said acylamino group is an acylamino group containing as acyl group substituents an acetyl group, a propanoyl group, a butanoyl group, a benzoyl group, or substituted benzoyl groups substituted with an alkyl group having 1 to 4 carbon atoms and/or a halogen atom; said acylimino group is an acylimino group containing as acyl group substituents the same acyl group substituents recited for said acylamino group and acylimino groups containing in addition to said acyl group alkyl groups having 1 to 4 carbon atoms, phenyl groups and substituted phenyl groups substituted with an alkyl group having 1 to 4 carbon atoms and/or a halogen atom as substituents; said alkylsulfoamido group is a methylsulfonamido group; said alkylthio group and said alkylseleno group are alkylthio and alkylseleno groups in which the alkyl group is a methyl group, an ethyl group, a propyl group, a butyl group, a t-butyl group, a pentyl group, a hexyl group, an octyl group or a benzyl group; said arylthio group and said arylseleno group are phenylthio and phenylseleno groups and said heterocyclic group is a heterocyclic group containing a 5- or 6-member ring containing at least one non-metal atom selected from the group consisting of a nitrogen, oxygen, sulfur and selenium atom.

3. The light-sensitive member for use in a color diffusion transfer element of claim 1, wherein said catechol derivative is 4-methoxycatechol, 4-propoxycatechol, 4-octyloxycatechol, 4-t-butoxycatechol, 3,4-dimethoxy-6-methylcatechol, 3,4,5-tribromo-6-methoxycatechol, 3-isobutoxycatechol, 3-hexyloxy-4-methoxycatechol, 5-aminoethyl-3-methoxycatechol, 4-acetylaminocatechol, 4-(N-acetyl-N-methylamino)-catechol, 4-acetylamino-5-chlorocatechol, 4-benzoylaminocatechol, 3,5-diacetylaminocatechol, 4-(N-methylsulfoamido)catechol, 4-butylmercaptocatechol, 4-benzylmercaptocatechol, 4-phenylselenocatechol, 4-(2′-morpholino)-catechol, 4,4′-(2′-aminothiazolyl)-catechol, 3-methyl-4-phenyl-mercaptocatechol, 3-benzylmercapto-4,6-di-t-butylcatechol, 1,2-diacetoxy-4-methoxybenzene or 2-acetoxy-3,4,5-tribromo-6-methoxyphenol.

4. The light-sensitive member for use in a color diffusion transfer element of claim 1, wherein said layer containing said auxiliary developing agent contains a synthetic polymer latex.

5. The light-sensitive member for use in a color diffusion transfer element of claim 1, wherein said auxiliary developing agent is present in an amount ranging from $5 \times 10^{-1}$ to $5 \times 10^{-5}$ mols/m$^2$ of said support.

6. The light-sensitive member for use in a color diffusion transfer element of claim 1, wherein said silver halide is silver chloride, silver bromide, silver bromochloride, silver iodobromide, silver iodobromochloride or a mixture thereof and wherein said dye developing agent is at least one of 4-(p-(2′,5′-dihydroxyphenyl)-phenylazo)-5-acetamido-1-naphthol, 4-(p-(2′,5′-dihydroxyphenethyl)-phenylazo)-5-benzamido-1-naphthol, 1-phenyl-3-methyl-4-(p-(2′,5′-dihydroxyphenethyl)-phenylazo)-5-pyrazolone, 2-(p-(2′,5′-dihydroxyphenethyl)-phenylazo)-4-acetamido-1-naphtohl, 2-(p-2′,5′-dihydroxyphenethyl)-phenylazo)-4-amino-1-naphthol, 2-(p-(2′,5′-dihydroxyphenethyl)-phenylazo)-4-methoxy-1-naphthol, 2-(p-(2′,5′-dihydroxyphenethyl)-phenylazo)-4-ethoxy-1-naphthol, 1-phenyl-3-N-n-butyl-carboxamido-4-(p-(2′,5′-dihydroxyphenethyl)-phenylazo)-5-pyrazolone, 1-phenyl-3-N-n-hexyl-carboxamido-4-(p-(2′,5′-dihydroxyphenethyl)-phenylazo)-5-pyrazolone, 1-phenyl-3-N-cyclohexylcarboxamido-4-(p-(2′,5′-dihydroxyphenethyl)-phenylazo)-5-pyrazolone, 1-phenyl-3-amino-4-(4′-(p-(2″,5″-dihydroxyphenethyl)phenylazo)-2′,5′-diethoxyphenylazo)-5-pyrazolone, 1-acetoxy-2-(p-(β-hydroquinonyl)-phenylazo)-4-methoxynaphthalene, 4-isopropoxy-2-(p-(β-hydroquinonyl-ethyl)-phenylazo)-1-naphthol, 1-acetoxy-2-(p-(β-hydroquinonyl-ethyl)-phenylazo)-4-propoxynaphthalene, 1,4-bis-(2′,5′-dihydroxyanilino)anthraquinone, 1,5-bis-(2′,5′-dihydroxyanilino)-4,8-dihydroxyanthraquinone, 1,4-bis-(β-(2′,5′-dihydroxyphenyl)-isopropylamino)-anthraquinone, 1,4-bis-(β-(2′,5′-dihydroxyphenyl)-ethylamino)-anthraquinone, 1-chloro-4-(β-(2′,5′-dihydroxyphenyl)-ethylamino)-anthraquinone, N-monobenzoyl-1,4-bis-(β-(2′,5′-dihydroxyphenyl)-ethylamino)-anthraquinone or 5,8-dihydroxy-1,4-bis-(β-hydroquinonyl-α-methyl)-ethylamino)-anthraquinone.

* * * * *